US008763464B2

(12) United States Patent
Emde et al.

(10) Patent No.: US 8,763,464 B2
(45) Date of Patent: Jul. 1, 2014

(54) METHOD AND APPARATUS FOR DETERMINING AN OPERATING POINT OF A WORK MACHINE

(75) Inventors: Christoph Emde, Bad Wildungen (DE); Stefan Laue, Gruenstadt (DE); Marjan Silovic, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 347 days.

(21) Appl. No.: 13/300,261

(22) Filed: Nov. 18, 2011

(65) Prior Publication Data

US 2012/0111114 A1 May 10, 2012

Related U.S. Application Data

(63) Continuation-in-part of application No. PCT/EP2010/055621, filed on Apr. 27, 2010.

(30) Foreign Application Priority Data

May 20, 2009 (DE) ..... 10 2009 022 107

(51) Int. Cl.
*G01H 1/04* (2006.01)
*G01H 9/00* (2006.01)

(52) U.S. Cl.
USPC ..... 73/659; 73/593; 73/660

(58) Field of Classification Search
USPC ..... 73/659, 660, 593; 702/41–44, 56
See application file for complete search history.

(56) References Cited

U.S. PATENT DOCUMENTS

| | | | | |
|---|---|---|---|---|
| 5,449,530 | A * | 9/1995 | Peake et al. | 427/244 |
| 6,260,004 | B1 * | 7/2001 | Hays et al. | 702/183 |
| 6,619,111 | B2 * | 9/2003 | Soneda et al. | 73/168 |
| 6,648,606 | B2 * | 11/2003 | Sabini et al. | 417/53 |
| 7,954,371 | B2 * | 6/2011 | Schofield et al. | 73/168 |
| 2003/0047008 | A1 | 3/2003 | Gopalakrishnan et al. | |
| 2007/0239371 | A1 | 10/2007 | Halbinger et al. | |
| 2011/0238264 | A1 * | 9/2011 | Wu | 701/36 |

FOREIGN PATENT DOCUMENTS

DE 29 46 049 A1 5/1981

(Continued)

OTHER PUBLICATIONS

International Search Report dated Jul. 13, 2010 including English-language translation (Four (4) pages).

(Continued)

*Primary Examiner* — J M Saint Surin
(74) *Attorney, Agent, or Firm* — Crowell & Moring LLP

(57) ABSTRACT

Method and apparatus for determining an operating point of a work machine and/or asynchronous motor driving the same, the operating point being characterized by the power consumed by and/or output rate of the machine, in which one or more operating point-dependent measurement variables of the machine are detected by sensors, and the measured values are evaluated and/or stored during operation of the machine. The operating point is determined without using electric measurement variables of the motor by determining a frequency linearly proportional to the fundamental tone of the machine through signal analysis, especially frequency analysis of a measured mechanical variable selected from pressure, differential pressure, power, vibration, and solid-borne or air-borne sound. From this, the rotational speed of the driving machine is determined, and the operating point characterized by the power consumed by and/or output rate of the machine is determined utilizing the rotational speed/torque relationship of the motor.

20 Claims, 16 Drawing Sheets

(56) References Cited

FOREIGN PATENT DOCUMENTS

| | | | |
|---|---|---|---|
| DE | 258 467 | A1 | 7/1988 |
| DE | 39 27 476 | A1 | 2/1991 |
| DE | 196 18 462 | A1 | 11/1997 |
| DE | 198 58 946 | A1 | 6/2000 |
| DE | 100 39 917 | A1 | 2/2002 |
| DE | 103 34 817 | A1 | 3/2005 |
| DE | 10 2006 049 440 | A1 | 4/2007 |
| DE | 10 2007 022 348 | A1 | 11/2008 |
| EP | 0 641 997 | B1 | 1/1998 |
| JP | 63-198792 | A | 8/1988 |
| JP | 2000-136790 | A | 5/2000 |
| JP | 2006-307682 | A | 11/2006 |
| JP | 2007-232508 | A | 9/2007 |
| WO | WO 2005/064167 | A1 | 7/2005 |

OTHER PUBLICATIONS

German Search Report dated Mar. 22, 2010 including partial English-language translation (Nine (9) pages).
PCT/ISA/237 (German-language) (Five (5) pages).
Corresponding International Preliminary Report on Patentability and English Translation of Written Opinion (eight (8) pages).
Japanese Office Action dated Feb. 25, 2014 (3 pages).

* cited by examiner

METHOD AND APPARATUS FOR DETERMINING AN OPERATING POINT OF A WORK MACHINE

CROSS REFERENCE TO RELATED APPLICATIONS

This application is a continuation-in-part of international patent application no. PCT/EP2010/055621, filed Apr. 27, 2010, designating the United States of America and published in German on Nov. 25, 2010 as WO 2010/133425, the entire disclosure of which is incorporated herein by reference. Priority is claimed based on Federal Republic of Germany patent application no. DE 10 2009 022 107.7, filed May 20, 2009, the entire disclosure of which is likewise incorporated herein by reference.

BACKGROUND OF THE INVENTION

The invention relates to a method for determining an operating point of a work machine and/or of an asynchronous motor driving the latter, a power input of the work machine and/or its delivery rate characterizing an operating point, one or more operating point-dependent measurement variables of the work machine being detected by one or more sensors, and the measurement values being evaluated and/or stored while the work machine is in operation. The invention relates, further, to a method for monitoring an operating point. The invention relates, furthermore, to an apparatus for carrying out the method.

In order to ensure that a work machine operates reliably and efficiently, its operating point must be known.

When a pump arrangement, in particular a centrifugal pump arrangement, composed of a pump and of an asynchronous machine driving the latter, is in operation, evidence of its operating point is often required. The operating point of a working turbomachine, in particular a centrifugal pump, on its delivery flow/delivery head characteristic curve or Q-H characteristic curve, is characterized in particular by its delivery flow, also hereafter called the delivery rate. There are various possibilities for determining this. It can be determined by measuring the delivery flow or by pressure measurement. In the latter case, the difference in pressure between the delivery side and suction side of the pump is usually measured. The delivery head is estimated as the quotient of the pressure difference, density and gravitational acceleration. In the case of water as a delivery fluid, a pressure difference of 1 bar corresponds to a delivery head of approximately 10 meters. Furthermore, an operating point of a centrifugal pump is determined by electrical measurement, the motor power output being calculated from current and voltage measurements, taking into account the efficiency of the motor.

Direct measurement of the delivery rate usually requires magnetoinductive flowmeters. Indirect determination of the delivery rate arithmetically presents additional difficulties. If, for example, a delivery rate is derived from the values of a delivery flow/delivery head characteristic curve, a Q-H characteristic curve, in which the delivery head H is plotted against the delivery flow, or of a delivery flow/power characteristic curve, a Q-P characteristic curve, in which the power P is plotted against the delivery flow Q, this is difficult or even impossible in those situations where there is a flat or a discontinuously rising Q-H characteristic curve or Q-P characteristic curve. If the delivery rate is to be determined by means of measured pressures from the Q-H characteristic curve of a centrifugal pump, the Q-H characteristic curve must be unequivocal, that is to say a Q value must be assignable exactly to each H value. This condition is often not fulfilled in practice. Q-H characteristic curves are either too flat or even ambiguous. The same problem also arises when the delivery flow Q is to be determined by means of a measured power input from the delivery flow/power characteristic curve, the Q-P characteristic curve. The profile of the Q-P characteristic curve is also often flat or even ambiguous.

A combination of the above methods is known from WO 2005/064167 A1. This entails a considerable outlay in measurement terms, since both the differential pressure of the pump and electrical power have to be measured.

Measuring the electrical power input of a motor/pump assembly entails a certain amount of outlay in practice. Active power measurement takes place in a switch cabinet, takes up space there, particularly for measuring the motor current by means of current transformers, and necessitates an outlay in assembly terms which has to be performed by specialized electricians.

An arrangement and a method for determining the power and/or torque of induction motors are described in DD 258 467 A1. A proximity switch is arranged on the rotor of an induction motor for the purpose of detecting one or more pulses per revolution of the motor shaft, and a pulse shaper stage for detecting the synchronous rotational speed from the line frequency is connected between the network and a microcomputer. In addition, the arrangement has a device for detecting the temperature of the motor and a microcomputer in which all the measurement data are acquired and evaluated for the purpose of regulating the further process sequence. The power and/or torque of the induction motor are/is determined from the time of one or more periods of the motor rotational speed and one or more periods of the synchronous rotational speed. The power and/or torque of the induction motor are/is determined by counting the pulses of the motor shaft within what is known as a gate time which is fixed by one or more periods of the synchronous rotational speed. The "Kloss equation" is used for determining the power and/or torque. The method requires a plurality of input variables, one of which is also the synchronous rotational speed which is determined from electrical measurement variables. In addition, the results have to be corrected as a function of the operating temperature of the motor, thus making it necessary to determine and store required correction factors per motor type by measurement beforehand. This arrangement has a complicated configuration. This method has proved to be unsuitable in industrial practice. It is a particular disadvantage, even when the active power input of an asynchronous motor is measured conventionally by active power meters and current transformers, that it is absolutely necessary that such an arrangement is installed by specialized electricians.

US 2007/239371 (=DE 10 2006 049 440) discloses a method for detecting an operating state of a pump, in particular of a centrifugal or positive displacement pump, in a pump plant. The method and its device serve for detecting a faulty operating state of a pump, pump plant and hydraulic plant, as compared with a stored normal state. A pressure sensor detects the pressure time profile in the delivery medium. A calculated characteristic value characterizes the pulsation of the pressure and/or flow profile in a calculation time interval. By the calculated characteristic value being compared with at least one stipulated characteristic value or with a characteristic value range delimited by this, the stipulated characteristic value or the characteristic value range delimited by this corresponding to a relevant operating state of the pump, the operating state is determined and output. In the case of a diagnostic appliance with a connected pressure sensor and with an additional oscillation sensor, the rotational speed of the pump is determined from the pressure sensor signal and is supplied to the oscillation sensor. The reasons for this are not disclosed. Neither the rotational speed information nor any other variables give evidence of the operating point on a Q-H or Q-P characteristic curve and/or the power input at which the pump is operated. Only deviations from predetermined and stored reference values are indicated by this method.

DE 196 18 462 A1 discloses a further method and a device for determining an extrinsic power parameter of an energy-converting device, such as the volume or mass throughflow through a motor-driven centrifugal pump, in which an operating state-dependent intrinsic variable is continuously determined.

SUMMARY OF THE INVENTION

The object on which the invention is based is to make available a method and an apparatus by means of which a less complicated, reliable determination and, where appropriate, monitoring of the current operating point of a work machine and/or of an asynchronous motor driving the latter are possible.

This object is achieved, according to the invention, in that the operating point is determined without the use of electrical measurement variables of the asynchronous drive motor, and in that a frequency linearly proportional to the rotational sound of the work machine is determined from a mechanical measurement variable, namely pressure, differential pressure, force, vibration, solid-borne noise or airborne noise, by means of signal analysis, in particular frequency analysis, the rotational speed of the drive machine being determined from this, and the operating point being determined from the slip-induced rotational speed/torque dependence of the asynchronous motor.

According to the invention, the operating point is determined without the use of electrical measurement variables. Instead, a frequency linearly proportional to the rotational sound of the work machine, in particular the rotational sound frequency of the work machine, is determined from the signal profile of a measured mechanical measurement variable. Rotational sound frequency is referred to hereafter for the sake of simplicity. This is obtained from the product of the rotational speed and a number of oscillation-exciting structures of an oscillating or rotating component, in particular the number of blades of a pump impeller. The rotational speed of the drive machine is determined from this, and the power input of the work machine, also called the shaft output hereafter, and/or its delivery rate are/is determined with the aid of stored data. Suitable mechanical measurement variables are pressure, in particular the pressure on the delivery side of a centrifugal pump, differential pressure, in particular the differential pressure between the suction side and delivery side of a centrifugal pump, force, vibration, solid-borne noise or airborne noise, in particular of or caused by a centrifugal pump, or the like. The operating point of the work machine can be determined from a single non-electrical measurement variable. By electrical measurement variables being dispensed with, the method according to the invention for determining an operating point is comparatively cost-effective and can be carried out at the simplest possible outlay in installation terms.

In a refinement of the invention, the power input of the work machine is determined by means of the following steps:

determination of the rotational speed/torque characteristic curve of the motor, in particular by means of stipulated motor parameters, namely design power and design rotational speed, if appropriate synchronous rotational speed, pull-out torque, pull-out rotational speed or pull-out slip, and determination of the power input or torque of the motor from the determined drive rotational speed and rotational speed/torque characteristic curve of the motor.

Requisite parameters for determining the rotational speed/torque characteristic curve of the motor are derived from the rating plate data of an asynchronous motor, for example the design or nominal torque $M_N$ is obtained from the quotient of the design power of the asynchronous motor $P_{2N}$ and nominal rotational speed $n_N$ as:

$$M_N = \frac{P_{2N}}{\omega_N} = \frac{P_{2N}}{2 \cdot \pi \cdot n_N} \tag{1}$$

If the pull-out torque $M_K$ and/or pull-out slip $s_K$ of the asynchronous motor are/is known, the rotational speed/torque characteristic curve, n-M characteristic curve, of the asynchronous motor is mapped by means of the Kloss equation $$\frac{M}{M_k} = \frac{2}{\frac{s}{s_k} + \frac{s_k}{s}} \tag{2}$$

With the slip s of the asynchronous motor being $$s = \frac{n_0 - n}{n_0} \tag{3}$$

the profile of the n-M characteristic curve is obtained as $$M(n) = \frac{2 \cdot M_k}{\frac{n_0 - n}{n_0 - n_k} + \frac{n_0 - n_k}{n_0 - n}} \tag{4}$$

with the pull-out rotational speed $n_K$ being $$n_k = n_0 \cdot \left(1 - \left(\sqrt{\left(\frac{M_k}{M_N} \cdot \frac{n_0 - n_N}{n_0}\right)^2 - \left(\frac{n_0 - n_N}{n_0}\right)^2} + \frac{M_k}{M_N} \cdot \frac{n_0 - n_N}{n_0}\right)\right) \tag{5}$$

Alternatively, in the operating range of the work machine, the rotational speed/torque characteristic curve of the asynchronous motor may be approximated as a straight line through the points ($M_N$; $n_N$), given by the nominal torque $M_N$ at the nominal rotational speed $n_N$, and (M=0; $n_0$), given by the torque M equal to zero in the case of a synchronous rotational speed $n_0$. This then results in the following approximated or simplified rotational speed/torque characteristic curve, n-M characteristic curve, of the asynchronous motor, the profile of which is described by the following formula:

$$M(n) = M_N \cdot \frac{n - n_0}{n_N - n_0} \tag{6}$$

The power input of the work machine is determined from the previously determined drive rotational speed, also called the shaft rotational speed hereafter, and from the rotational speed/torque characteristic curve, the n-M characteristic curve, of the motor. This relation of the shaft output $P_2$ to the torque M and rotational speed n is given by the equation $$P_2=\omega\cdot M=2\cdot\pi\cdot n\cdot M \tag{7}$$

According to the invention, the operating point of a work machine, in particular a pump, characterized by its power input, is determined. This takes place by means of existing sensors arranged on a pump.

An advantageous refinement provides, in the case of a pump, in particular a centrifugal pump, as a work machine, for determining its delivery rate from its drive rotational speed. The rotational sound frequency is determined from the signal profile from a non-electrical measurement variable by means of signal analysis, in particular frequency analysis, for example Fast Fourier Transformation (FFT) or autocorrelation. The drive rotational speed is determined from this. In the example of a centrifugal pump as a work machine, the rotational speed is obtained as the quotient of the rotational sound frequency $f_D$ and number of blades z of the impeller:

$$n=\frac{f_D}{z} \tag{8}$$

The shaft output and/or delivery rate can be determined from the rotational speed by means of the rotational speed/torque dependence. Measurement of electrical variables is dispensed with, with the result that the outlay for carrying out operating point determination is reduced considerably, as compared with conventional operating point determination based on electrical active power measurement. Likewise, as compared with direct measurement of the delivery rate, for example by means of ultrasonic throughflow measurement technology or magnetoinductive throughflow measurement technology, there is a considerable cost benefit, since the mechanical measurement variables used, namely pressure, differential pressure, force, vibration, solid-borne noise or airborne noise, are detected and processed in a more favorable way.

It has proved to be advantageous to determine the delivery rate of the pump from the power input or shaft output determined from the drive rotational speed. First, as described above, the shaft output of the pump is determined according to formula (7) from the drive rotational speed or shaft rotational speed with the aid of the known n-M characteristic curve or an n-P characteristic curve derivable from this. In a subsequent step, the delivery rate Q of the pump is determined from the shaft output by means of a stored Q-P characteristic curve.

The delivery rate of the pump can be determined from parameters of the motor, which describe a rotational speed/torque characteristic curve of the motor, and also from parameters of the pump, which describe a delivery flow/power characteristic curve, and from the drive rotational speed. A Q-P characteristic curve can be described, for example, in the form of a parameter table with a plurality of support points ($_{1}$ to $_{i}$). During the determination of an operating point, the method uses such a prestored table in order to determine the delivery rate from the shaft output:

| | | | | | |
|---|---|---|---|---|---|
| Delivery rate Q | $Q_{_1}$ | $Q_{_2}$ | $Q_{_3}$ | ... | $Q_{_i}$ |
| Shaft output $P_2$ | $P_{2_1}$ | $P_{2_2}$ | $P_{2_3}$ | ... | $P_{2_i}$ |

The table may additionally contain support points for the respective rotational speed, whereby it becomes possible to determine the delivery flow directly from the determined rotational speed.

Particularly in ambiguous regions of the Q-P characteristic curve, the delivery head or differential pressure may additionally be used for determining the delivery rate of the pump for the purpose of a further improvement in the method. Moreover, to determine the operating point, both the Q-P characteristic curve and the Q-H characteristic curve can be taken into account. For this purpose, for example, quotient values $P_2/H$ can be stored:

| | | | | | |
|---|---|---|---|---|---|
| Delivery rate Q | $Q_{_1}$ | $Q_{_2}$ | $Q_{_3}$ | ... | $Q_{_i}$ |
| Shaft output $P_2$ | $P_{2_1}$ | $P_{2_2}$ | $P_{2_3}$ | ... | $P_{2_i}$ |
| Delivery head H | $H_{_1}$ | $H_{_2}$ | $H_{_3}$ | ... | $H_{_i}$ |
| Quotient $P_2/H$ | $P_{2_1}/H_{_1}$ | $P_{2_2}/H_{_2}$ | $P_{2_2}/H_{_2}$ | ... | $P_{2_i}/H_{_i}$ |

There is likewise provision for determining the delivery rate of the centrifugal pump from a characteristic curve which represents the load-dependent rotational speed change against the delivery rate of the pump. Such a rotational speed/delivery flow characteristic curve can be calculated from a rotational speed/torque characteristic curve of the motor in conjunction with a delivery flow/power characteristic curve.

| | | | | | |
|---|---|---|---|---|---|
| Delivery rate Q | $Q_{_1}$ | $Q_{_2}$ | $Q_{_3}$ | ... | $Q_{_i}$ |
| Shaft output $P_2$ | $P_{2_1}$ | $P_{2_2}$ | $P_{2_3}$ | ... | $P_{2_i}$ |
| Rotational speed n | $n_{_1}$ | $n_{_2}$ | $n_{_3}$ | ... | $n_{_i}$ |

Alternatively, even without knowing the Q-P and Q-H characteristic curves, a characteristic curve for determining the delivery rate can be determined from the load-dependent rotational speed change. For this purpose, the respective operating rotational speed can be determined and stored in a test run of the pump, which takes place, for example, during commissioning, at a plurality of operating points with a known delivery rate, including, for example, $Q_0$, that is to say a delivery flow equal to zero, and $Q_{max}$, that is to say the maximum permissible delivery flow. This results in the parameter table presented in general hereafter:

| | | | | | |
|---|---|---|---|---|---|
| Delivery rate Q | $Q_{_1}$ | $Q_{_2}$ | $Q_{_3}$ | ... | $Q_{_i}$ |
| Rotational speed n | $n_{_1}$ | $n_{_2}$ | $n_{_3}$ | ... | $n_{_i}$ |

Alternatively, it is possible that rotational speeds are determined and stored by "learning" during the regular operation of the pump. Thus, in a centrifugal pump with a Q-P characteristic curve in which P rises strictly monotonically in proportion to Q, as, for example, in most pumps with a radial wheel, the highest rotational speed occurring is assigned to the lowest power input occurring and to the smallest delivery flow, if appropriate with the valve closed, that is to say a zero delivery flow. If the rotational speed decreases again during operation, a risen delivery flow is inferred from this. Thus, over the operating period of a centrifugal pump, an operating range within the limits of ($Q_{min}'$; $n_{max}'$) and ($Q_{max}'$; $n_{min}'$) which occur in the investigated operating period is learnt, without concrete values for Q being measured or determined for this purpose. The learnt limit values are used for classifying the in each case current delivery flow of the centrifugal pump between the minimum delivery flow $Q_{min}'$ and the maximum delivery flow $Q_{max}'$ which have occurred during the investigated operating period.

According to this refinement, the rotational speed/torque dependence of the asynchronous motor is also employed. The invention in this case makes use of the knowledge that this brings about an evaluatable rotational speed change over the delivery flow range. By means of such a characteristic curve, which is usually not documented for a pump, the delivery rate of the centrifugal pump can be determined directly from the rotational speed.

According to one especially reliable method, the drive rotational speed or shaft rotational speed is determined from measurement values of one or more pressure sensors for the purpose of determining the operating point of the pump, in particular the centrifugal pump. It is advantageous in this case if the pressure sensors are suitable for the dynamic measurement of pressures, in particular of pulsating pressures. The operating point of the pump, in particular a centrifugal pump, which is characterized by the shaft output and/or delivery rate is therefore determined solely from measurement values of one or more pressure sensors. One or more pressure sensors are employed on a centrifugal pump in order to detect the suction and/or ultimate pressure of a centrifugal pump. Pressure sensors, although provided for measuring static pressures, are also most suitable for the dynamic measurement of pressures. Tests have shown that standard pressure sensors detect pressures dynamically, and undamped, up to a frequency range of approximately 1 kHz. Such pressure sensors are capable of detecting pulsating pressures occurring within a centrifugal pump. The method according to the invention achieves sufficient accuracy for many applications when only one pressure sensor is used on the delivery side of the pump. In addition, a pressure sensor may be provided on the suction side of the pump. There is likewise provision for evaluating a pump differential pressure between the delivery side and suction side of the pump, obtainable by means of a differential pressure sensor. By virtue of the method according to the invention, the operating point can be determined cost-effectively, without the use of additional sensors, solely from one or more pressure sensor signals.

In another refinement, the drive rotational speed is determined from measurement values of one or more solid-borne noise and/or airborne noise sensors for the purpose of determining the operating point of the work machine and/or of the asynchronous motor driving the latter. In this case, the solid-borne noise and/or airborne noise sensors may be arranged on the work machine and/or on the asynchronous motor driving the latter. The sensors may also be arranged in the surroundings of the work machine. In any event, a frequency which is linearly proportional to the rotational sound of the work machine and from which the rotational speed of the work machine is determined is detected from signals of the sensors which detect mechanical measurement variables. And the operating point is determined from this, using the rotational speed/torque dependence of the asynchronous motor.

According to the invention, a determined operating point can be monitored as to whether it is inside or outside a stipulated permissible range. A faulty operating state, in particular overload or underload, of the work machine and/or of the asynchronous motor is detected on the basis of an operating point which is located outside a stipulated range. By the power input of a centrifugal pump being monitored or evaluated, for example, operation under partial load or optimum operation can be inferred. If solid-borne noise or airborne noise is used as a measurement variable, dry running of the centrifugal pump can also be detected. Tests have shown that the detection according to the invention of an overload of an asynchronous motor functions reliably and robustly. If the power input is increased, as compared with a documented and parameterized power input, an overload of the pump or motor can be inferred. Admittedly, a supply-side undervoltage may also be cause of an allegedly increased power input, thus leading to increased slip. In such a case, the diagnosis of an overload for the assembly composed of the pump and motor is nevertheless correct, since, in the case of undervoltage and therefore increased slip, the current consumption of the motor is increased. This influence is significant when the line voltage lies outside the tolerances and, for example, lies more than 10% below the nominal voltage. In such a case, at a nominal rotational speed $n=n_N$, a nominal power $P_2=P_{2N}$ will be inferred, even though the actual power input lies below the nominal power. If the rotational speed falls any further, that is to say $n<n_N$, overloading of the pump or motor is inferred, this being correct, since the current-proportional losses, in particular the rotor losses from the asynchronous motor, rise, thus contributing to the excessive heating of the motor.

In an apparatus for determining an operating point of a work machine and/or of an asynchronous motor driving the latter, the apparatus being provided with one or more inputs for the detection of operating point-dependent measurement variables, there is provision, according to the invention, whereby the apparatus has a data store for technological data of the work machine and/or of the asynchronous motor driving the latter, and determines a frequency linearly proportional to the rotational sound of the work machine from a mechanical measurement variable, namely pressure, differential pressure, force, vibration, solid-borne noise or airborne noise, by means of signal analysis, in particular frequency analysis, determines the rotational speed of the drive machine from this, and from this, using the slip-induced rotational speed/torque dependence of the asynchronous motor, determines and, if appropriate, monitors the operating point from non-electrical measurement variables, without the use of electrical measurement variables of the driving asynchronous motor.

The data store can store motor parameters which describe the rotational speed/torque dependence of the asynchronous motor and/or other technological data of the work machine arrangement. These can be accessed, for the purpose of determining the operating point, while the work machine is in operation. There is no need for electrical measurement variables to be detected by the apparatus. The apparatus can determine the operating point of the work machine from a single measurement signal, for example a pressure sensor signal.

According to a refinement of the invention, the apparatus determines the power input of the work machine by the following steps:

determining the rotational speed/torque characteristic curve of the motor, in particular by means of stipulated motor parameters, namely design power and design rotational speed, optionally synchronous rotational speed, pull-out torque, pull-out rotational speed or pull-out slip, and determining the power input or torque of the motor from the drive rotational speed and the rotational speed/torque characteristic curve of the motor.

In a pump, in particular a centrifugal pump, as a work machine, there is provision for a delivery rate of the pump to be determined from the drive rotational speed. Only mechanical measurement variables are detected on the pump. The drive or shaft rotational speed of the pump is determined from the determined rotational sound frequency.

There is a considerable cost benefit, as compared with direct measurement of the delivery rate, for example, by means of ultrasonic throughflow measurement technology or magnetoinductive throughflow measurement technology.

Outlay and costs are also minimized, as compared with determining the delivery rate on the basis of electrical active power measurement.

The apparatus may be arranged on the pump, on its drive motor or in its surroundings and/or may be integrated with the pump or its drive motor.

The apparatus can determine the delivery rate of the pump, in particular centrifugal pump, from the power input or shaft output determined from the drive rotational speed or shaft rotational speed.

It has proved advantageous that the apparatus determines the delivery rate of the pump, in particular centrifugal pump, from parameters of the motor, which describe a rotational speed/torque characteristic curve of the motor, and also from parameters of the pump, which describe a delivery flow/power characteristic curve, and from the drive rotational speed or shaft rotational speed.

There is just as easy provision for the apparatus to determine the delivery rate of the pump, in particular a centrifugal pump, directly from a characteristic curve which represents the load-dependent rotational speed change against the delivery rate of the pump. Such a characteristic curve can be determined by means of test runs and stored in the data store, so that it can be retrieved while the centrifugal pump is in operation. The rotational speed/torque dependence of the asynchronous motor is nevertheless used here, which leads to a rotational speed variation over the delivery flow range. The operating point characterized by the power input of the work machine and/or its delivery rate can be determined from this in an especially simple way.

It is advantageous if the apparatus has at least one connection for a pressure sensor and from measurement values of a connected pressure sensor determines the drive rotational speed or shaft rotational speed for the purpose of determining the operating point of the work machine. Pressure sensors for detecting static pressures are likewise capable of detecting dynamic pressure fluctuations. Such pressure sensors are mounted in any case on many pumps, particularly in order to detect their ultimate pressure. Conventional devices for the detection of signals from pressure sensors by means of analog inputs, for example on store-programmable controls or on frequency converters, usually enable filtered, that is to say dynamically damped measurement values to be used. Such inputs are too slow and insensitive for detecting the dynamic pressure signal component which is relevant according to the invention.

Highly dynamic inputs which are capable in measuring devices of detecting signal components in frequency ranges of a few kilohertz are mostly not sufficiently robust and, moreover, are costly in industrial practice.

The apparatus according to the invention differs from what is conventional in industrial terms, as mentioned, in that it makes it possible to detect the pulsating component of a pressure signal, while at the same time having high dynamics. This ensures that the frequency of the pulsating pressure component is determined exactly in a relevant frequency range. The apparatus advantageously comprises an input for signal components of up to approximately 500 Hz, a limit frequency for an input filter being correspondingly higher.

It has proved advantageous that the frequency range relevant for a specific pump is a small extract, delimited by a lower and an upper rotational sound frequency $f_{D_min}$ and $f_{D_max}$, of the overall measured frequency range. Evaluation can therefore take place correspondingly selectively and accurately. In an example of a centrifugal pump, the relevant frequency range is stipulated by the limits of lower and upper rotational sound frequency $f_{D_min}$ and $f_{D_max}$ in the case of a known number of blades z:

$$f_{D_min}=n_{min}\cdot z \text{ and } f_{D_max}=n_{max}\cdot z \quad (9, 10)$$

In this case, the minimum rotational speed $n_{min}$ and maximum rotational speed $n_{max}$ are known from parameters of the asynchronous motor driving the centrifugal pump. The minimum rotational speed can be calculated in a simplified way from $n_N$, for example $$n_{min}=0.95\cdot n_N \quad (11)$$

And/or the maximum rotational speed can be assumed to be $$n_{max}=n_0 \quad (12).$$

Optimizing the efficiency of asynchronous motors entails minimizing the slip as a deviation of the shaft rotational speed from the synchronous rotational speed. IEC standard motors with a nominal power of 22 kW and above usually have a nominal slip of less than 2%, in the case of higher powers the slip is even lower and may even be less than 1%. The result of this is that the minimum and maximum rotational speed and the minimum and maximum rotational sound frequency may lie very closely to one another. So that an operating point can be determined from the rotational sound frequency, the latter must be determined very exactly. According to the invention, therefore, the apparatus has a signal processing unit which carries out an exact determination of the rotational sound frequency, preferably with an accuracy of 1/10 Hertz or of a few 1/100 Hertz. This is achieved by means of a very high sampling frequency and/or by means of a correspondingly long sampling interval.

In this case, the amplitude of the pulsating pressure component is relatively low. In a concrete example, the amplitude of the pulsating signal component amounts to less than 1% of the pressure. The apparatus processes the measurement range of the pressure signal with correspondingly high resolution, so that the pressure pulsation can be evaluated satisfactorily according to analog/digital conversion in spite of the low amplitude, that is to say the rotational sound frequency can be determined. The apparatus according to the invention thus makes it possible to determine an operating point of a pump reliably.

Alternatively and/or additionally, the apparatus may have at least one connection for a solid-borne noise and/or airborne noise sensor and from measurement values of a connected solid-borne noise and/or airborne noise sensor can determine the drive rotational speed for the purpose of determining the operating point of the work machine and/or of the asynchronous motor driving the latter.

For the detection of operating point-dependent noise measurement variables, the apparatus advantageously is connectable to a microphone or has an integrated microphone.

It is advantageous in this case if the apparatus comprises a telephone, in particular a mobile telephone, for detecting the operating noises of the work machine and for determining and/or monitoring an operating point. Such an apparatus uses the method according to the invention. For this purpose, a program sequence can be stored in a data store of the apparatus and can be processed by a computing unit located in the apparatus.

The apparatus may also, separated spatially from the work machine, determine and, if appropriate, monitor the operating point of the latter. There is in this case provision for the apparatus to use telecommunication means, in particular a telephone or mobile telephone and a telecommunication network, in order to carry out the determination and/or monitoring of an operating point at a location other than the operating location of the work machine. The telecommunication means in this case serve as signal detection and/or transmission means. For example, a mobile telephone can pick up solid-borne noise and/or airborne noise signals from a work machine by means of a built-in microphone and can transfer them by means of a telecommunication network to a device, separated spatially from the work machine, for determining and/or monitoring an operating point.

The invention can be used advantageously in a centrifugal pump arrangement composed of at least one centrifugal pump with a shaft and an asynchronous motor driving the shaft and with one or more sensors for the detection of operating point-dependent measurement variables. The device may be arranged on the centrifugal pump and/or be integrated into the centrifugal pump and/or the asynchronous motor. An arrangement in the surroundings of the centrifugal pump arrangement or a spatially separate arrangement is also provided.

BRIEF DESCRIPTION OF THE DRAWINGS

The invention will be described in further detail hereinafter with reference to illustrative embodiments shown in the accompanying drawing figures, in which.

DETAILED DESCRIPTION OF PREFERRED EMBODIMENTS

Figure 1A:
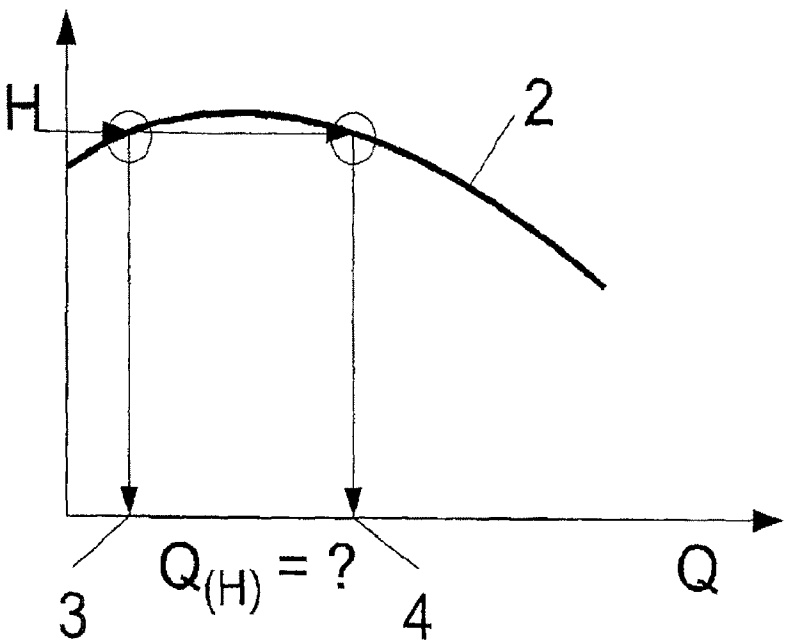
FIG. 1*a* shows a Q-H characteristic curve of a centrifugal pump.

FIG. 1*a* shows a delivery flow/delivery head characteristic curve 2, what is known as a Q-H characteristic curve, of a centrifugal pump. According to the prior art, a delivery head H of the pump can be determined from a pressure difference measured between the delivery side and suction side of the centrifugal pump, and the operating point of the centrifugal pump can be determined via the delivery flow/delivery head characteristic curve 2. However, determining an operating point in this way is insufficient in a range of smaller delivery flows in which the delivery flow/delivery head characteristic curve 2 is ambiguous or unstable. Such a characteristic curve which is unstable has the effect that, in the case of specific measured pressure differences in relation to a specific delivery head H, there are two delivery flow values 3, 4. A delivery rate Q(H) of the centrifugal pump therefore cannot be inferred unequivocally.

Figure 1B:
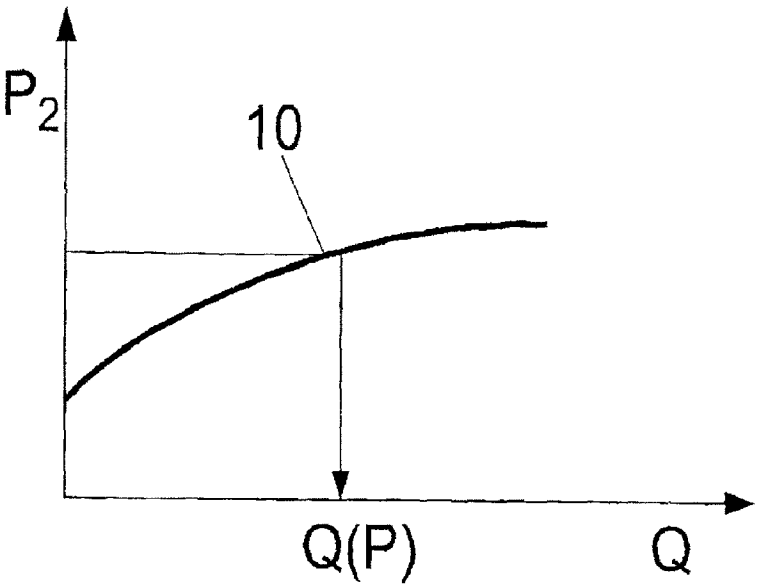
FIG. 1*b* shows a Q-P characteristic curve of a centrifugal pump.

FIG. 1*b* shows a delivery flow/power characteristic curve 10, what is known as a Q-P characteristic curve, of a centrifugal pump. The delivery flow/power characteristic curve 10 shown here is unequivocal, so that, with information on the power input of the pump, it is possible to have evidence of the delivery rate Q(P) of the pump and therefore of its operating point. Measuring the electrical power input of a centrifugal pump assembly entails a certain amount of outlay in practice, since it takes place in a switch cabinet and necessitates an outlay in assembly terms which has to be performed by specialized electricians. Both the Q-H characteristic curve 2 and the Q-P characteristic curve 10 are typically documented for a specific centrifugal pump.

Figure 2:
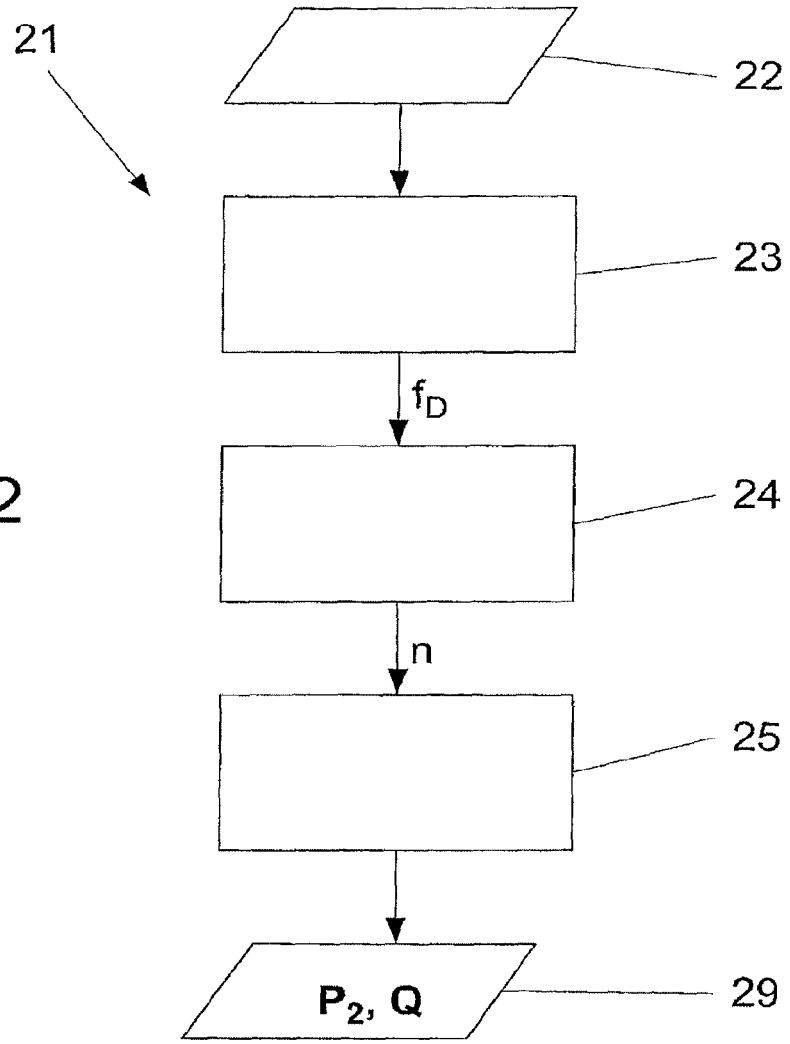
FIG. 2 shows a general diagrammatic illustration of the method according to the invention.

FIG. 2 shows a general diagrammatic illustration of a method 21 according to the invention, in which the operating point of a work machine and/or of an asynchronous motor driving the latter is determined without the use of electrical measurement variables of the driving asynchronous motor. After detection 22 of a mechanical measurement variable, in a step 23 a frequency linearly proportional to the rotational sound of the work machine, a rotational sound frequency $f_D$, is determined from the measurement variable by means of signal analysis, in particular frequency analysis. In a next step 24, the rotational speed n of the drive machine is determined from this. And in a further step 25, the operating point characterized by the power input of the work machine, designated here by $P_2$, and/or its delivery rate Q is determined. For this purpose, according to the invention, the slip-induced rotational speed/torque dependence of the asynchronous motor driving the work machine is used. The operating point thus determined is available in step 29 for further processing and/or indication.

Figure 3:
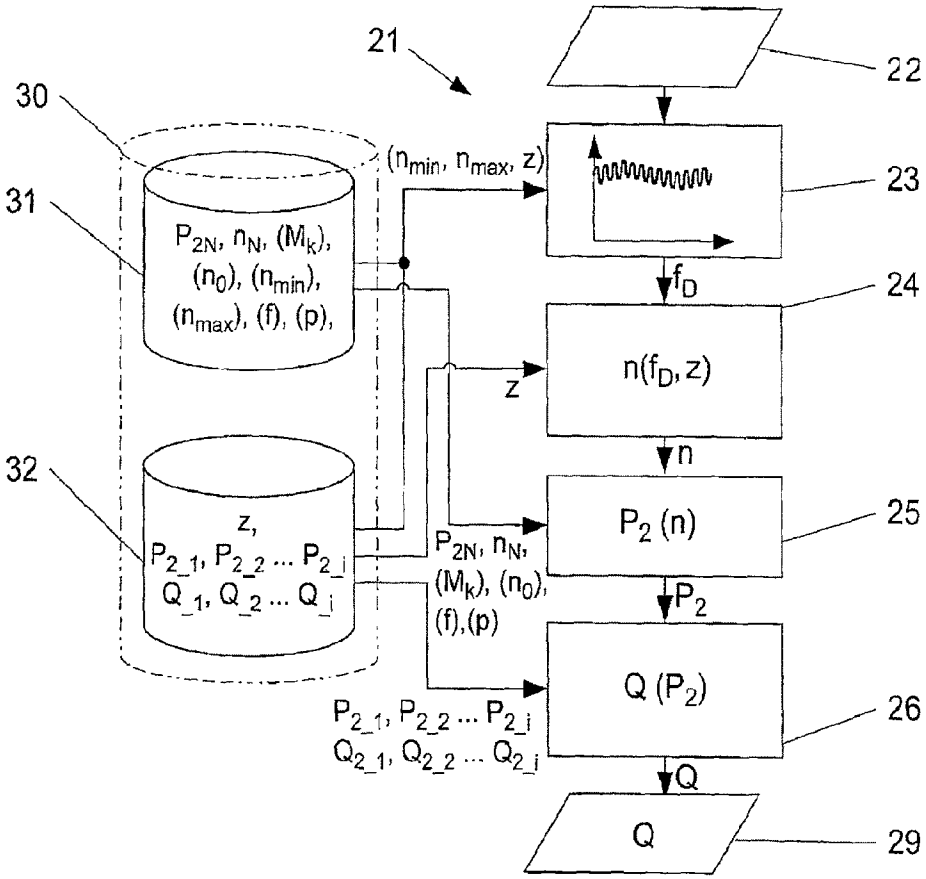
FIG. 3 shows a diagrammatic illustration of the method steps of a first method for determining an operating point.

FIG. 3 shows a diagrammatic illustration, more detailed in comparison with FIG. 2, of the method steps of a method 21 for determining an operating point. What is shown is a method 21 for determining a delivery flow or delivery rate Q from a measured pressure pulsation or measured solid-borne noise or airborne noise via a stored motor model and a pump characteristic curve. The parameters necessary for carrying out the individual method steps can be stored or filed in a data store 30 and are available for carrying out the individual method steps. The required motor parameters, namely design or nominal power output $P_{2N}$ and nominal rotational speed $n_N$, and the optional motor parameters, namely line frequency f, number of pairs of poles p or synchronous rotational speed $n_0$, in this case form a motor model which is advantageously deposited in a first part 31 of the data store 30. The synchronous rotational speed $n_0$ can also be determined from the line frequency f and number of pairs of poles p or can be derived from the nominal rotational speed $n_N$ as the theoretically possible synchronous rotational speed next higher to this (for example, 3600 $min^{-1}$, 3000 $min^{-1}$, 1800 $min^{-1}$, 1500 $min^{-1}$, 1200 $min^{-1}$, 1000 $min^{-1}$, 900 $min^{-1}$, 750 $min^{-1}$, 600 $min^{-1}$ or 500 $min^{-1}$). The pull-out torque $M_k$ of the motor, if it is known, may optionally be stored. Furthermore, a minimum rotational speed $n_{min}$ and a maximum rotational speed $n_{max}$ can be stored. A delivery flow/power characteristic curve, a Q-P characteristic curve, of a centrifugal pump is stored in a second part 32 of the data store 30. This characteristic curve is given by a plurality (i) of support values ($P_{2_1}$; $Q_{_1}$), ($P_{2_1}$; $Q_{_2}$), . . . ($P_{2_i}$; $Q_{_i}$). The number of blades z of the impeller of the centrifugal pump is also available. In a step 22, measurement values of a mechanical measurement variable are detected while a work machine is in operation. In a method step 23, the rotational sound frequency $f_D$ is then determined, for example, within the limits of $f_{Dmin}=n_{min}\cdot z$ according to formula (9) and $f_{Dmax}=n_{max}\cdot z$ according to formula (10) by means of signal analysis from the signal pulsations. In a further method step 24, the instantaneous drive rotational speed of the pump is determined from the rotational sound frequency $f_D$ and the number of blades z. The following applies:

$$n = \frac{f_D}{z} \tag{8}$$

In a next method step 25, the power output $P_2$ of the motor is determined from the drive rotational speed n thus determined. The following in this case applies:

$$P_2=\omega\cdot M=2\cdot\pi\cdot n\cdot M, \tag{7}$$

in which $$M = \frac{2\cdot M_k}{\frac{n_0-n}{n_0-n_k}+\frac{n_0-n_k}{n_0-n}}. \tag{4}$$

The power output $P_2$ of the motor corresponds to the shaft output of the pump. Thus, in a next method step 26, the delivery rate Q of the pump can be determined with the aid of the Q-P characteristic curve of the latter. By means of the method, the operating point of the work machine, here a centrifugal pump, is determined from the measurement variable and its signal pulsation without the measurement of electrical measurement variables.

Figure 4A:
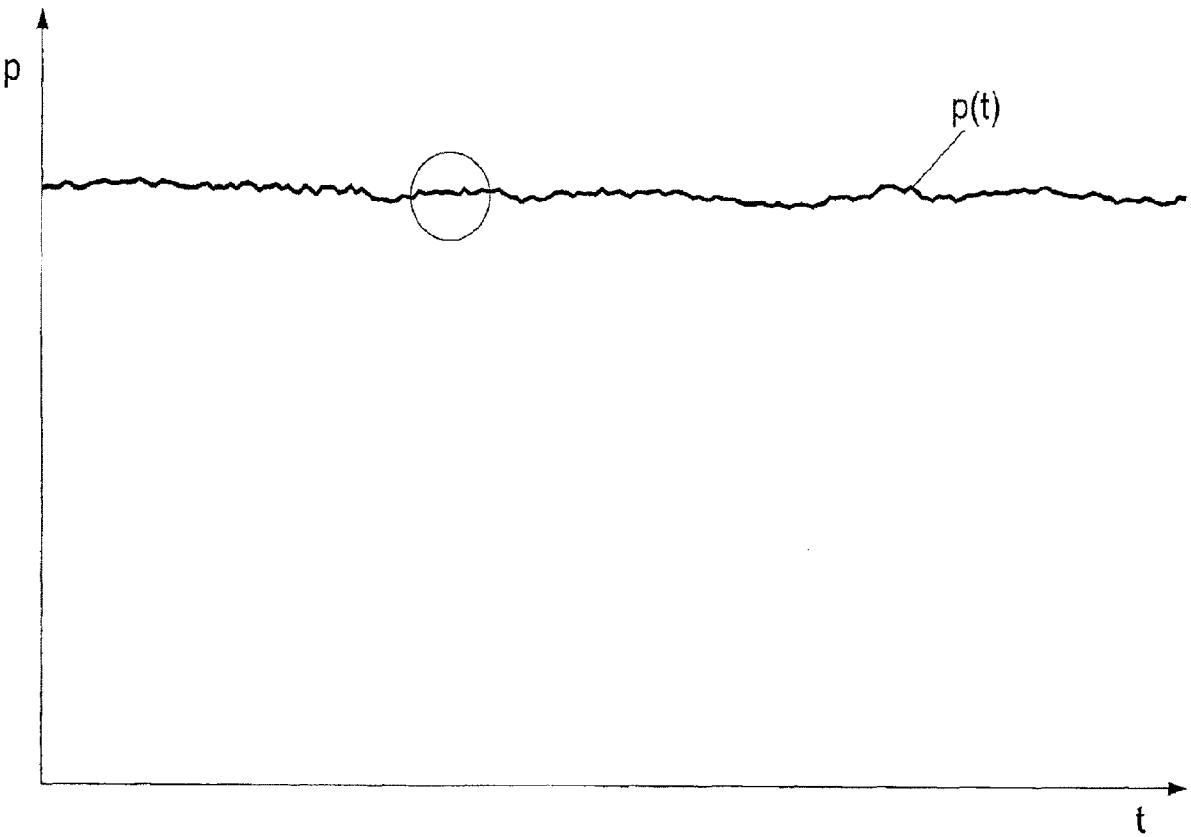
FIG. 4*a* shows a pressure profile at the outlet of a centrifugal pump.

FIG. 4*a* illustrates as a function of a time t a signal profile of a pressure p(t) which was measured at the outlet of a centrifugal pump while the latter was in operation. It can be seen that the pressure moves approximately at a constant level which remains the same.

Figure 4B:
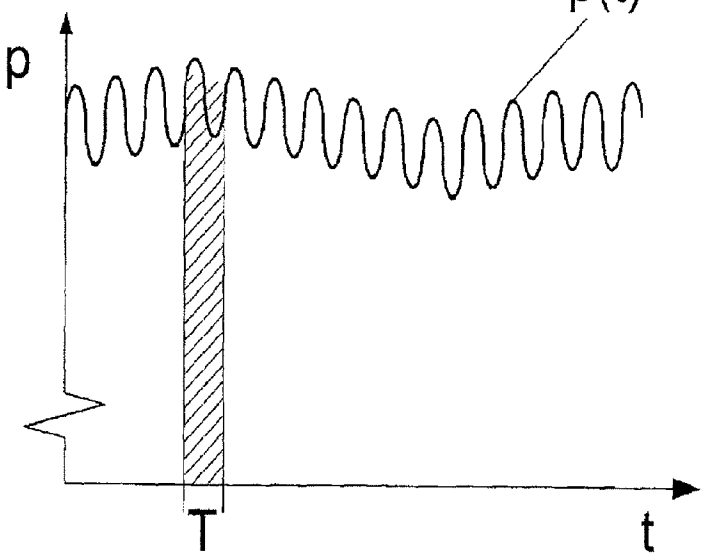
FIG. 4*b* shows the pressure profile in a view of a detail.

FIG. 4*b* shows this pressure profile p(t) in a view of a detail. It can be seen that pressure pulsations are present in the signal profile of p(t). It was recognized, according to the invention, that these pressure pulsations can be detected by commercially available pressure sensors for measuring a static pressure. Such pressure sensors are mounted in any case on many pumps, particularly in order to detect their ultimate pressure. Such a pressure sensor detects a pulsating component of the pressure signal. The frequency of the pulsating pressure component, the rotational sound frequency $f_D$, is obtained from the reciprocal value of the period duration T. The method according to the invention determines the frequency of the pulsating pressure component in a relevant frequency range. If the number of blades z is known, the relevant frequency range is stipulated by the limits of the lower and the upper rotational sound frequency $f_{D_min}$ and $f_{D_max}$. The following applies:

$$f_{D_min}=n_{min}\cdot z \text{ and } f_{D_max}=n_{max}\cdot z \tag{9, 10}$$

In this, $n_{min}$ is a minimum rotational speed and $n_{max}$ a maximum rotational speed of the asynchronous motor driving the centrifugal pump. These either are known or can be calculated in simplified form, for example by $$n_{min}=0.95\cdot n_N \tag{11}$$

and $$n_{max}=n_0 \tag{12}$$

$n_0$ representing the synchronous rotational speed. To determine the rotational sound frequency within the relevant frequency range exactly, in the method according to the invention an exact determination of the rotational sound frequency is carried out preferably with an accuracy of one tenth of a Hertz or even of a few hundredths of a Hertz. This is achieved either by means of a very high sampling frequency and/or by means of a correspondingly long sampling interval. The rotational sound frequency $f_D$ is determined by means of signal analysis, in particular frequency analysis, for example by Fast Fourier Transformation (FFT) or by an autocorrelation analysis. As already stated, the drive rotational speed n of the centrifugal pump or of the drive motor driving the latter can be determined from the rotational sound frequency $f_D$.

Figure 5A:
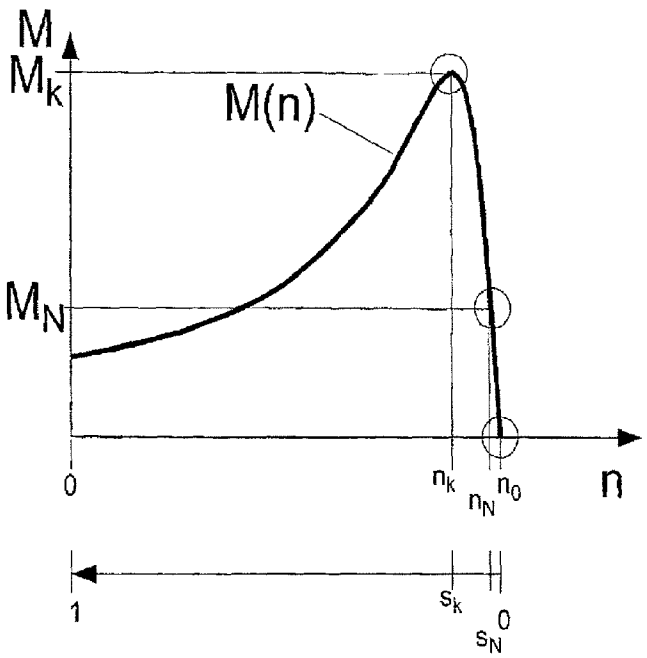
FIG. 5*a* shows a rotational speed/torque characteristic curve of an asynchronous motor.
Figure 5B:
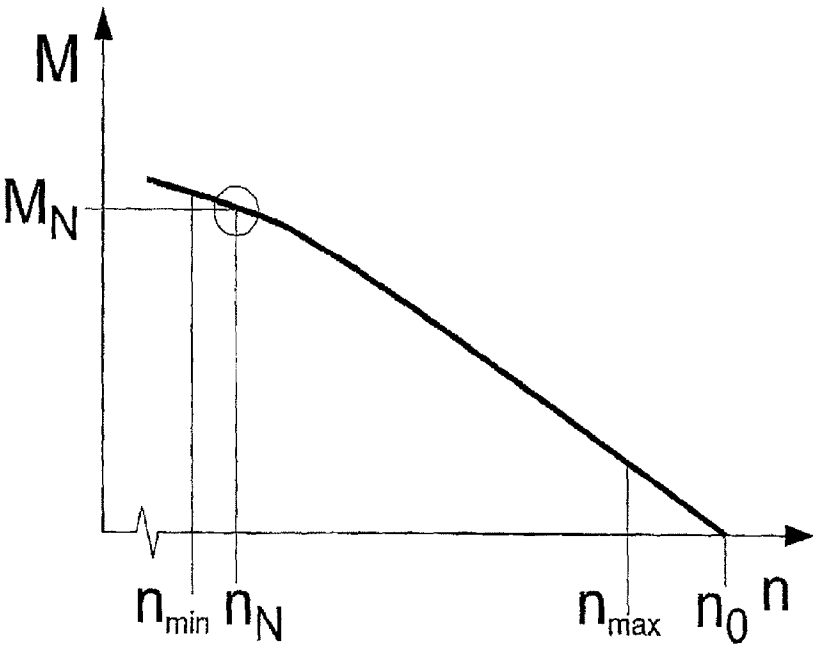
FIG. 5*b* shows a simplified rotational speed/torque characteristic curve of an asynchronous motor in its operating range.

FIGS. 5*a* and 5*b* serve for explaining method step 25. FIG. 5*a* shows a rotational speed/torque characteristic curve M(n), also referred to hereafter as an n-M characteristic curve, of an asynchronous motor. In such a rotational speed/torque characteristic curve M(n), the torque M is plotted against the rotational speed n of the asynchronous motor. This characteristic curve which per se is known for and is typical of an asynchronous motor shows the design or nominal operating point of an asynchronous motor at a point ($M_N$; $n_N$) in the case of a nominal torque $M_N$ and nominal rotational speed $n_N$, circled here. At the synchronous rotational speed $n_0$, the torque of the asynchronous motor is equal to 0. A formula for the torque M(n) is obtained as $$M(n) = \frac{2\cdot M_k}{\frac{n_0-n}{n_0-n_k}+\frac{n_0-n_k}{n_0-n}} \tag{4}$$

Figure 6A:
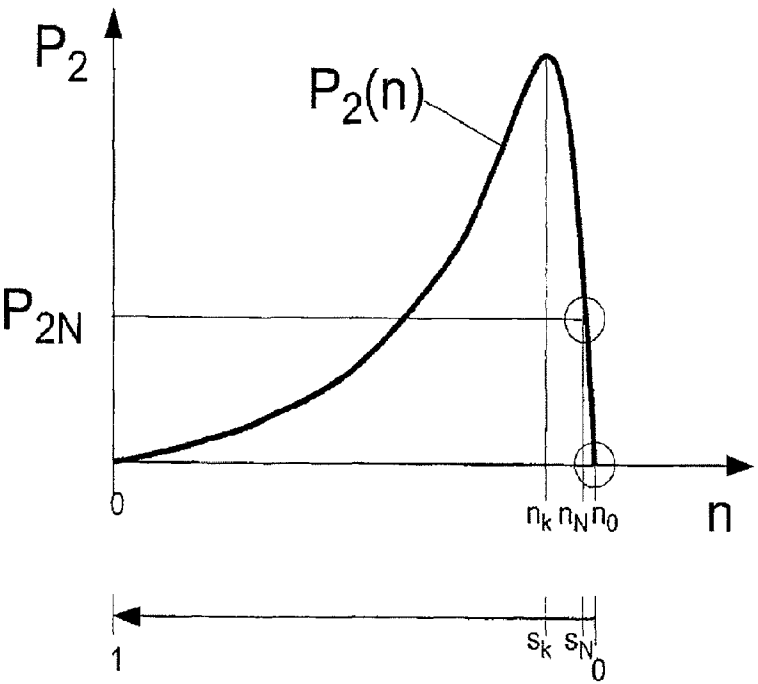
FIGS. 6*a* and 6*b* show n-P characteristic curves of the asynchronous motor which are derived from this.

FIG. 6*a* shows a rotational speed/power characteristic curve or n-P characteristic curve, derived from this, of the asynchronous motor, with $$P_2(n) = \frac{4\cdot\pi\cdot n\cdot M_k}{\frac{n_0-n}{n_0-n_k}+\frac{n_0-n_k}{n_0-n}} \tag{13}$$

The motor parameters required for calculating the characteristic curve M(n) or $P_2(n)$ can in this case be derived from rating plate data of an asynchronous motor. In this case, it is especially advantageous if the profile of the n-P characteristic curve is determined solely from the rating plate data, namely the design power $P_{2N}$ and design rotational speed $n_N$. The synchronous rotational speed $n_0$ can be derived from these two parameters which are usually evident on the rating plate of each asynchronous motor. The pull-out torque $M_k$ is usually known from the manufacturer's specifications or can be set roughly to a suitable multiple of the nominal torque, for example to triple the latter. The pull-out rotational speed $n_k$ can be calculated according to formula (5).

In the operating range of a work machine, the rotational speed/torque characteristic curve of the asynchronous motor from FIG. 5*a* can be approximated as a straight line through the points ($M_N$; $n_N$), given by the nominal torque $M_N$ at the nominal rotational speed $n_N$, and (M=0; $n_0$), given by the torque M=0 at the synchronous rotational speed $n_0$. The following simplified rotational speed/torque characteristic curve, n-M characteristic curve, of the asynchronous motor is obtained:

$$M(n) = M_N \cdot \frac{n - n_0}{n_N - n_0} \tag{6}$$

Figure 6B:
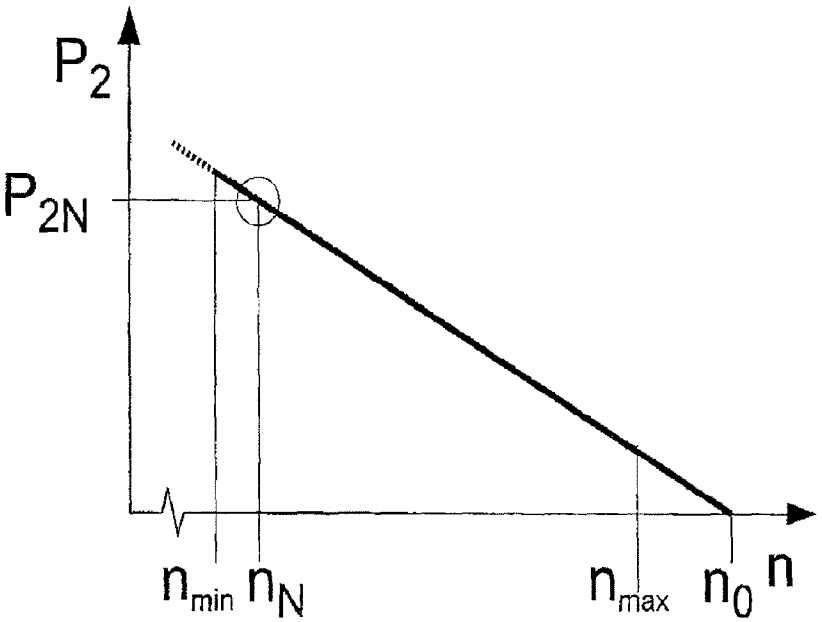

This approximated or simplified rotational speed/torque characteristic curve is illustrated in FIG. 5*b* and the simplified rotational speed/power characteristic curve derived from it is illustrated in FIG. 6*b*:

$$P_2(n) = P_{2N} \cdot \frac{n - n_0}{n_N - n_0} \tag{15}$$

In both cases, with a simplified linear n-P characteristic curve according to formula (15) or using the n-P characteristic curve according to formula (13) derived from the Kloss formula, the power input $P_2(n)$ of a work machine can be determined from the drive rotational speed n in a method step 25.

With the knowledge of the power input $P_2$ of the work machine, and using the Q-P characteristic curve, the delivery rate Q can be determined in a method step 26.

Figure 7:
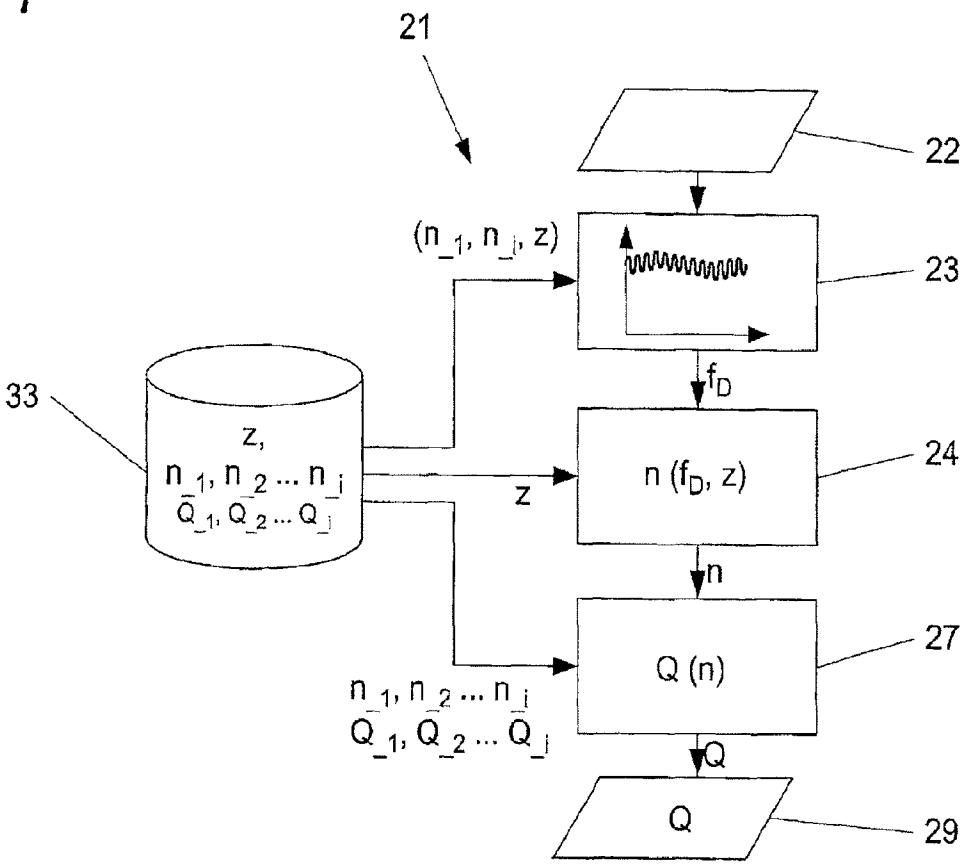
FIG. 7 shows a diagrammatic illustration of an alternative method using a load-dependent rotational speed/delivery flow characteristic curve.
Figure 8:
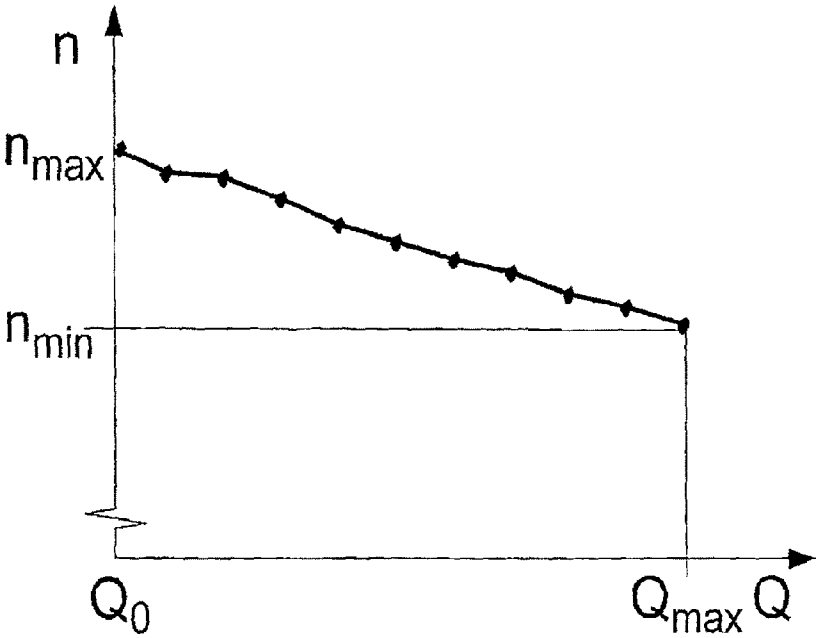
FIG. 8 shows a load-dependent rotational speed/delivery flow characteristic curve.

FIG. 7 shows a diagrammatic illustration of an alternative method 21 according to the invention, using a load-dependent rotational speed/delivery flow characteristic curve or n-Q characteristic curve. In this method, the number of blades z and a load-dependent rotational speed/delivery flow characteristic curve n(Q), given by a plurality (i) of support values ($n_1$; $Q_1$), ($n_2$; $Q_2$), . . . ($n_i$; $Q_i$), are stored in a data store 33. It was recognized, according to the invention, that there is an evaluatable rotational speed change over the delivery flow range. Such a load-dependent rotational speed/torque characteristic curve can be determined by learning and stored during regular operation of the pump. Alternatively, the respective operating rotational speed can be determined and stored in a test run of the pump, which takes place, for example, during the commissioning of the pump, for a plurality of operating points with a known delivery rate, including, for example, $Q_0$, $Q_{max}$. Once again, in the method illustrated in FIG. 7, detection 22 of a measurement variable is carried out, and the drive rotational speed n of the work machine is determined via method steps 23 and 24. In the method shown in FIG. 7, the instantaneous delivery rate Q is then determined in a method step 27 with the aid of the support values ($n_1$; $Q_1$), ($n_2$; $Q_2$), . . . ($n_i$; $Q_i$). The delivery rate Q of the centrifugal pump can therefore be determined directly from the rotational speed n. Such a load-dependent rotational speed/delivery flow characteristic curve, which is usually not documented for a pump, is shown in FIG. 8.

Figure 9:
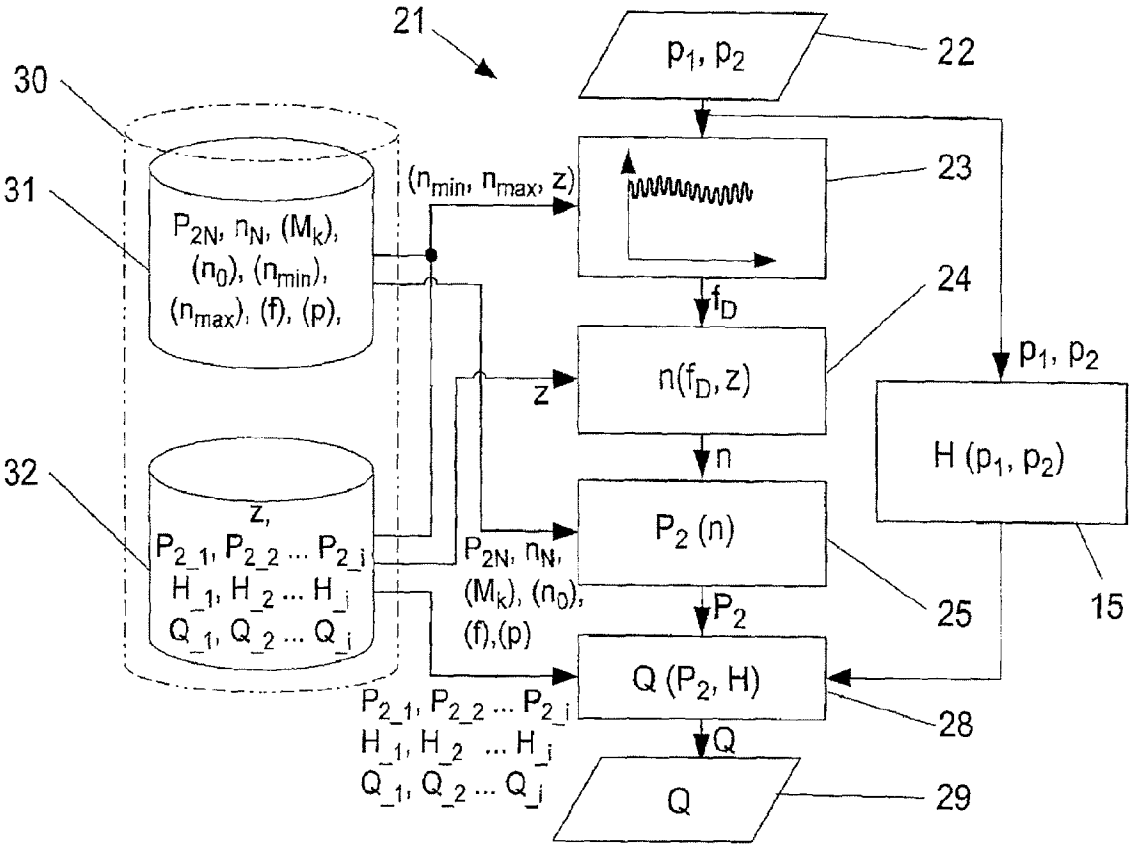
FIG. 9 shows a diagrammatic illustration of a combined method for determining an operating point.

FIG. 9 shows a combined method for determining Q which carries out a determination of an operating point both from the delivery head H and from the power $P_2$. In this method, too, the pressure pulsation of the delivery-side pressure $p_2$ is used for determining the shaft output $P_2$ and the delivery rate Q. The method once again contains the method steps 23, 24 and 25 already described in FIG. 3. Once again, the parameters already described in FIG. 3 and also the Q-P characteristic curve are stored in a data store 30. In addition, the delivery flow/delivery head characteristic curve, the Q-H characteristic curve, of the centrifugal pump is deposited. For this purpose, the support table for the Q-P characteristic curve is supplemented by corresponding delivery head values $H_1$, $H_2$ . . . $H_i$.

To determine the delivery rate Q, in a method step 28 the delivery rate is determined according to a combined method from the delivery flow/delivery head characteristic curve and delivery flow/power characteristic curve of the centrifugal pump. The determination of an operating point can therefore be carried out more accurately and more reliably. The required delivery head H is calculated in a method step 15 from the ultimate pressure $p_2$ and the suction pressure $p_1$.

Figure 10:
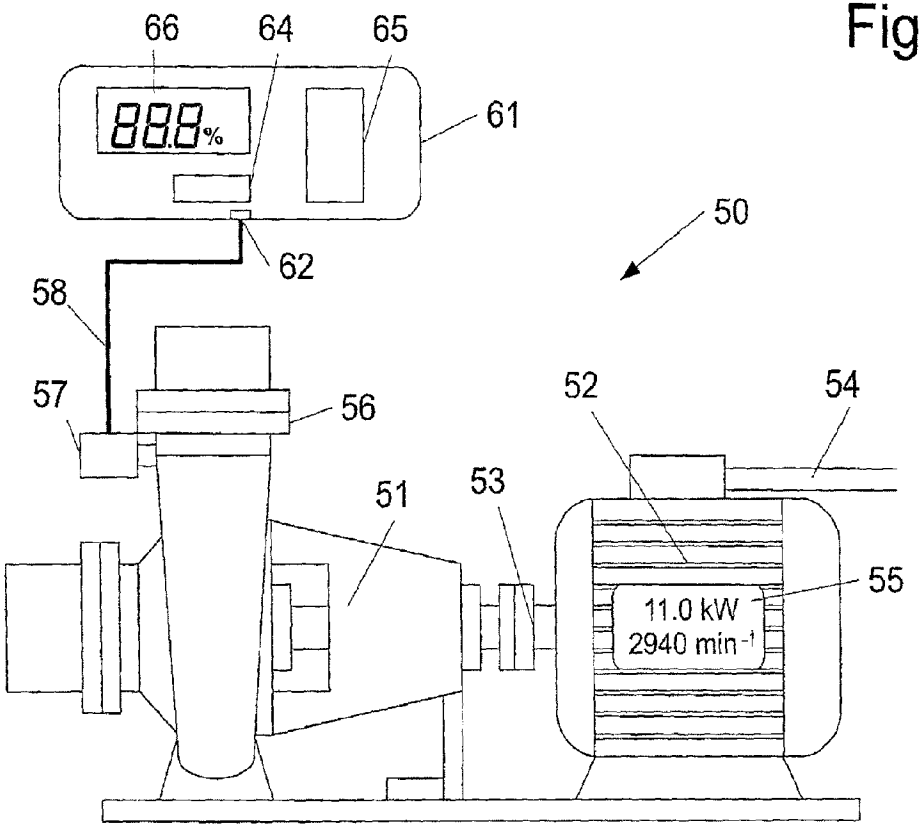
FIG. 10 shows a centrifugal pump arrangement with an apparatus according to the invention for determining an operating point from a measured pressure pulsation.

FIG. 10 shows a centrifugal pump arrangement 50 in which a centrifugal pump 51 is connected via a shaft 53 to an asynchronous motor 52 which drives the centrifugal pump 51. For this purpose, the asynchronous motor 52 is fed from a network feed line 54. The asynchronous motor 52 has a rating plate 55 having characteristic quantities of the asynchronous motor 52. A pressure connection piece 56 of the centrifugal pump 51 has arranged on it a pressure sensor 57 for measuring the delivery-side pressure or ultimate pressure of the centrifugal pump 51. The pressure sensor 57 is connected via a line 58 to an apparatus 61 according to the invention. The apparatus 61 according to the invention evaluates the measurement signals from the pressure sensor 57 and determines the operating point of the work machine 51. It uses the method according to the invention for this purpose. The rating plate data, namely the nominal power $P_{2N}$ and the nominal rotational speed $n_N$, are sufficient as characteristic quantities of the asynchronous motor for carrying out the method. All other motor parameters can be derived or calculated from these. The apparatus 61 has a connection or signal input 62 suitable for detecting the pressure signals. It has proved advantageous to design the signal input 62 for signal components up to 500 Hz. Such an input is more cost-effective than a highly dynamic input, which can detect signals in the frequency range of a few kilohertz, and affords the possibility of sufficiently rapid and sensitive signal detection. Furthermore, the apparatus 61 comprises a signal processing unit 64 which determines the rotational sound frequency $f_D$ with sufficient accuracy. The signal processing unit 64 is capable of determining the rotational sound frequency with an accuracy of one tenth of a Hertz or of a few hundredths of a Hertz. It has a high sampling frequency and/or correspondingly long sampling intervals. The method performed by the apparatus 61 is controlled and coordinated by a computing unit 65. Furthermore, the apparatus 61 has an indicator and/or operating unit 66. A further pressure sensor connection, not illustrated here, may be provided on the apparatus and serves, for example, for detecting a pump suction pressure. Moreover, the apparatus may have further signal inputs, not illustrated here, and/or a serial bus interface, for example for the read-in or read-out of parameters.

Figure 11:
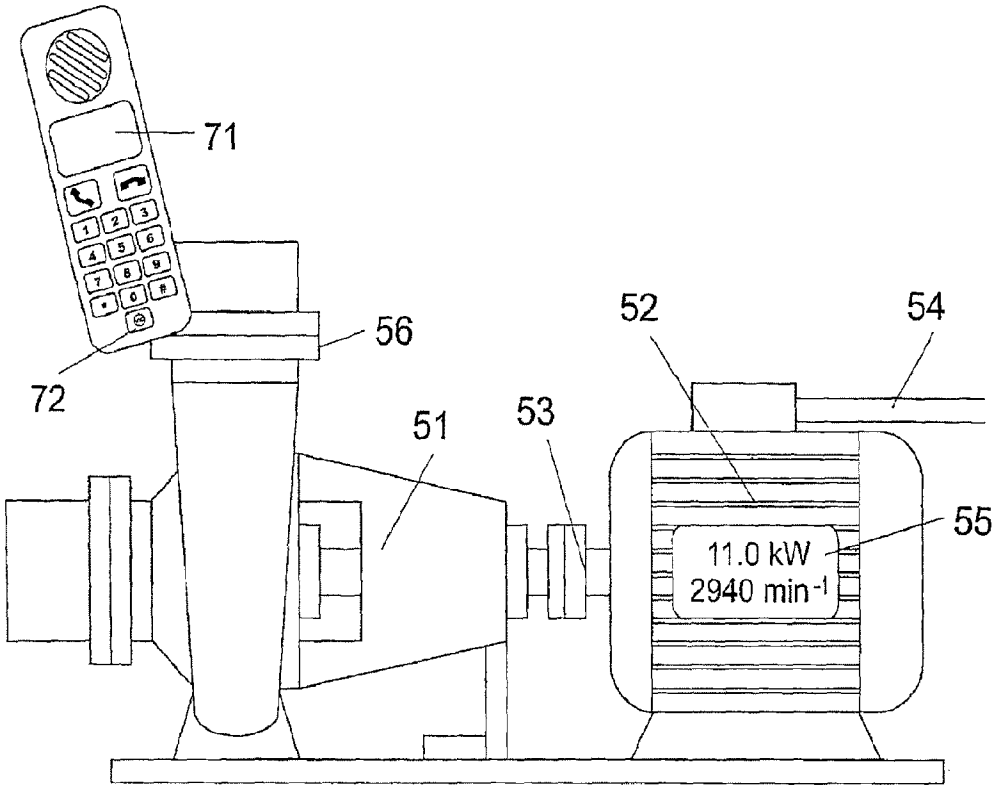
FIG. 11 shows a centrifugal pump arrangement with an apparatus according to the invention for determining an operating point in the form of a mobile telephone.

FIG. 11 shows a centrifugal pump arrangement composed of a centrifugal pump 51 and asynchronous motor 52, and an apparatus for determining an operating point in the form of a mobile telephone 71. This determines the operating point of the centrifugal pump 51 from the airborne noise transmitted by the centrifugal pump 51. For this purpose, the mobile telephone 71 has an integrated microphone 72. In this exemplary embodiment, the mobile telephone 71 uses the method according to the invention. For this purpose, an appropriate program sequence can be stored in a data store, not illustrated here, of the mobile telephone 71 and is processed by a computing unit, not illustrated here, which is located in the mobile telephone.

Figure 12:
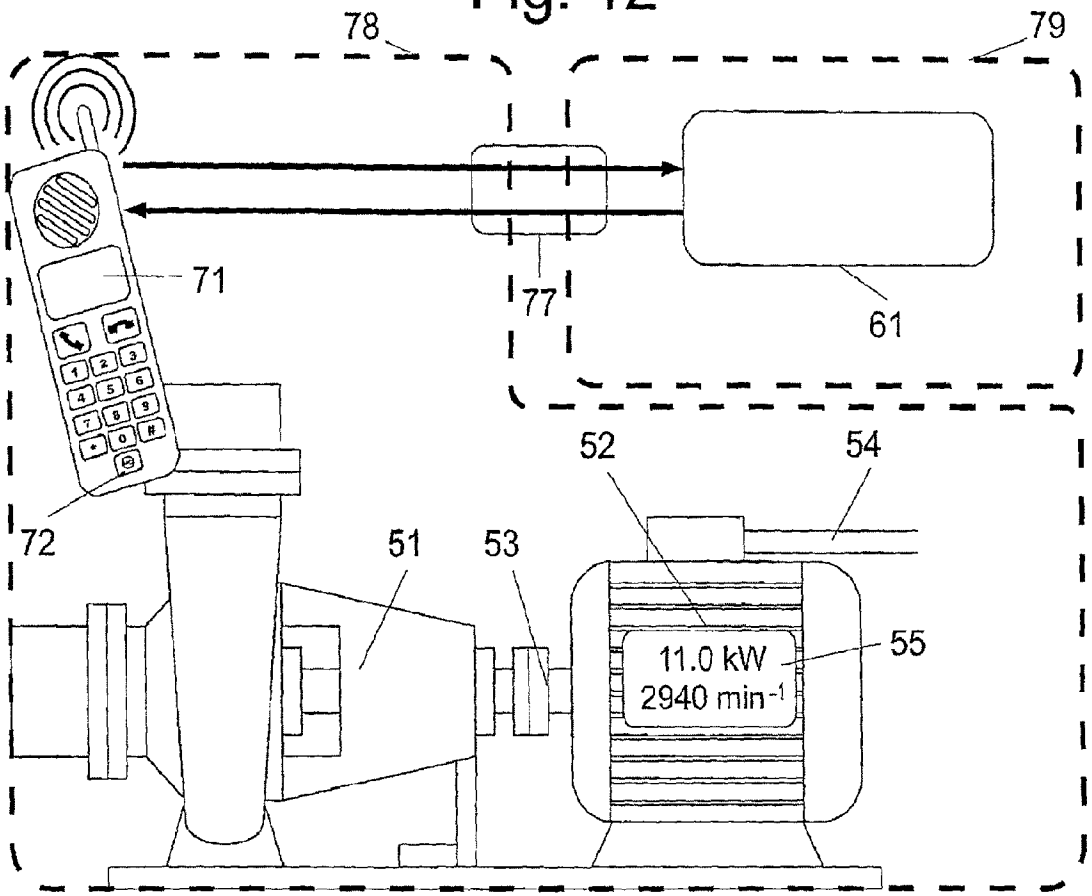
FIG. 12 shows a further arrangement with an apparatus which uses a mobile telephone and a telecommunication network in order to carry out the determination of an operating point at a location other than the operating location of the centrifugal pump.

As illustrated in FIG. 12, the apparatus can also determine the operating point of a work machine while being separated spatially from the latter. FIG. 12 shows the same centrifugal pump arrangement as in FIG. 11, composed of a centrifugal pump 51 and asynchronous motor 52. A mobile telephone 71 with an integrated microphone 72 detects the operating noises of the work machine 51 at an operating location 78, indicated by a dashed line, of the centrifugal pump 51 and of the asynchronous motor 52. For this purpose, the mobile telephone 71 detects the airborne noise signals of the work machine 51. An apparatus 61 for determining an operating point is arranged, spatially separated from the work machine 51, at a location 79 where operating point determination is carried out. The apparatus 61 uses telecommunication means, which serve as signal transmission means, in order to carry out operating point determination while being separated spatially from the work machine 51. The airborne noise signals of the centrifugal pump 51 which are detected by the mobile telephone 71 are transmitted or transferred to the apparatus 61 by means of a telecommunication network 77.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method for determining an operating point of a work machine or of an asynchronous motor driving the such a machine, wherein the operating point is characterized by a power input of the work machine or by a delivery rate of the work machine;

one or more operating point-dependent measurement variables of the work machine are detected by one or more sensors;

measured values of the variables are evaluated or stored while the work machine is in operation; and the operating point is determined without the use of electrical measurement variables of the asynchronous drive motor;

said method comprising:

determining a frequency linearly proportional to the rotational sound of the work machine by signal analysis of a measured mechanical variable selected from the group consisting of pressure, differential pressure, force, vibration, solid-borne noise, and airborne noise;

determining the rotational speed (n) of the drive machine from said frequency; and determining the operating point from the slip-induced rotational speed/torque dependence of the asynchronous motor.

2. The method as claimed in claim 1, wherein the power input ($P_2$) of the work machine is determined by:

determining the rotational speed/torque characteristic curve (M(n)) of the motor based on at least one motor parameter selected from the group consisting of design power, design rotational speed ($n_N$), if appropriate synchronous rotational speed ($n_0$), pull-out torque ($M_k$), pull-out rotational speed ($n_k$) and pull-out slip ($s_k$); and determining the power input ($P_2$) or torque (M) of the motor from the determined drive rotational speed (n) and the rotational speed/torque characteristic curve (M(n)) of the motor.

3. The method as claimed in claim 1, wherein said work machine is a centrifugal pump;

said method further comprising determining a delivery rate (Q) of the pump from the rotational speed (n) of the pump drive.

4. The method as claimed in claim 3, wherein the delivery rate (Q) of the pump is determined from the power input ($P_2$) determined from the rotational speed (n) of the pump drive.

5. The method as claimed in claim 3, wherein the delivery rate (Q) of the pump is determined from:

parameters of the motor, which describe a rotational speed/torque characteristic curve (M(n)) of the motor;

parameters of the pump, which describe a delivery flow/power characteristic curve of the pump; and the drive rotational speed (n).

6. The method as claimed in claim 3, wherein the delivery rate (Q) of the centrifugal pump is determined from a characteristic curve which represents the load-dependent rotational speed change against the delivery rate (Q) of the pump.

7. The method as claimed in claim 3, wherein the drive rotational speed (n) for determining the operating point of the centrifugal pump, is determined from measurement values of at least one pressure sensor.

8. The method as claimed in claim 1, wherein the drive rotational speed (n) for determining the operating point of the work machine or of the asynchronous motor driving the work machine, is determined from measured values measured by at least one solid-borne noise sensor or airborne noise sensor.

9. A method for monitoring the operating point of a work machine or an asynchronous motor driving a work machine; said method further comprising detecting a faulty operating state comprising an overload or an underload of the work machine or the asynchronous motor based on determination of an operating point according to claim 1, wherein the determined operating point is located outside a stipulated range.

10. An apparatus for determining or monitoring an operating point of a work machine or an asynchronous motor driving a work machine, wherein said operating point is characterized by a power input of the work machine or a delivery rate of the work machine;

said apparatus comprises at least one input for detection of operating point-dependent measurement variables, and a data store for storing technological data of the work machine or the asynchronous motor driving the work machine; and wherein said apparatus determines a frequency linearly proportional to the rotational sound of the work machine through signal analysis of a measured mechanical variable selected from the group consisting of pressure, differential pressure, force, vibration, solid-borne noise and airborne noise;

determines the rotational speed (n) of the drive machine from the determined frequency, and determines, and optionally monitors, the operating point from non-electrical measurement variables and from the slip-induced rotational speed/torque dependence of the asynchronous motor.

11. The apparatus as claimed in claim 10, wherein the power input of the work machine is determined by:

determining the rotational speed/torque characteristic curve (M(n)) of the motor from stipulated motor parameters selected from the group consisting of design power ($P_{2N}$), design rotational speed ($n_N$), if appropriate synchronous rotational speed ($n_0$), pull-out torque ($M_k$), pull-out rotational speed ($n_k$) and pull-out slip ($s_k$); and determining the power input ($P_2$) or torque (M) of the motor from the drive rotational speed (n) and the rotational speed/torque characteristic curve (M(n)) of the motor.

12. The apparatus as claimed in claim 10, wherein the work machine is a centrifugal pump, and the operating point determination involves determining a delivery rate (Q) of the pump from the drive rotational speed (n).

13. The apparatus as claimed in claim 12, wherein the apparatus determines the delivery rate (Q) of the centrifugal pump from the power input ($P_2$) determined from the drive rotational speed (n).

14. The apparatus as claimed in claim 12, wherein the apparatus determines the delivery rate (Q) of the centrifugal pump from parameters of the motor, which describe a rotational speed/torque characteristic curve (M(n)) of the motor;

parameters of the pump, which describe a delivery flow/power characteristic curve of the pump; and the drive rotational speed (n).

15. The apparatus as claimed in claim 12, wherein the apparatus determines the delivery rate (Q) of the centrifugal pump from a characteristic curve which represents the load-dependent rotational speed change plotted verses the delivery rate (Q) of the pump.

16. The apparatus as claimed in claim 10, wherein:

the apparatus comprises at least one signal input for a pressure sensor; and from measurement values of a connected pressure sensor determines the drive rotational speed (n) for the purpose of determining the operating point of the work machine.

17. The apparatus as claimed in claim 10, wherein the apparatus comprises at least one signal input for a connected solid-borne noise or airborne noise sensor, and determines the drive rotational speed (n) for determining the operating point of the work machine or of the asynchronous motor driving the work machine from measured values measured by the connected solid-borne noise or airborne noise sensor.

18. The apparatus as claimed in claim 10, wherein the apparatus is connected to a microphone or comprises an integrated microphone for detecting operating point-dependent measurement variables.

19. The apparatus as claimed in claim 18, wherein the apparatus comprises a mobile telephone for detecting operating noises of the work machine and for determining and optionally monitoring an operating point.

20. The apparatus as claimed in claim 18, wherein the determination and optional monitoring of the operating point of the work machine is carried out remotely at a location other than the location of the work machine via a telecommunication device and telecommunication network.

* * * * *